United States Patent [19]

Buta

[11] Patent Number: 4,824,036

[45] Date of Patent: Apr. 25, 1989

[54] APPARATUS FOR THE SPIRAL WINDING OF ELONGATED OBJECTS, ESPECIALLY STRANDS OF HAIR

[76] Inventor: Ramos K. Buta, Kohlenstr. 105, D-3500 Kassel, Fed. Rep. of Germany

[21] Appl. No.: 103,831

[22] Filed: Oct. 1, 1987

[30] Foreign Application Priority Data

Oct. 2, 1986 [DE] Fed. Rep. of Germany ... 8626352[U]

[51] Int. Cl.[4] ..... A45D 8/00; B65H 81/06

[52] U.S. Cl. ..... 242/7.19; 57/10; 57/18; 242/7.02; 132/212; 132/271; 132/273

[58] Field of Search ..... 57/3, 4, 10, 11, 16–18; 242/7.01, 7.02, 7.19–7.23; 132/33 R, 9, 33 A, 33 B, 34 R, 34 B, 34 C, 39, 56, 46 R

[56] References Cited

U.S. PATENT DOCUMENTS

| | | | |
|---|---|---|---|
| 1,392,611 | 10/1921 | Adams | 57/10 |
| 1,927,261 | 9/1933 | Evans | 132/33 A |
| 2,208,963 | 7/1940 | Diehl | 57/10 |
| 3,162,992 | 12/1964 | Davis et al. | 57/10 |
| 3,259,370 | 7/1966 | Neale, Sr. | 57/10 X |
| 3,463,412 | 8/1969 | McCaffray, Jr. et al. | 242/7.19 |
| 3,851,831 | 12/1974 | Steiner et al. | 57/10 X |
| 4,346,550 | 8/1982 | Ferree | 57/10 |

*Primary Examiner*—John Petrakes

[57] ABSTRACT

The invention relates to an apparatus for the spiral winding of elongated objects, especially hair strands, with at least one winding material in the form of a thread or the like. This apparatus contains a casing (6), an annular disk (7) journaled thereon with a central opening in which a tube (2) intended for the accommodation of the object (3) and having an axis (5) and two ends, a motor (8) for the rotation of the disk (7), at least one spool for the winding material (14) rotatable about an axis (11) and journaled on the disk (7), and at least one guide (12) for the winding material (14), which is fastened to the disk (7) and disposed in the vicinity of one of the tube ends.

12 Claims, 4 Drawing Sheets

APPARATUS FOR THE SPIRAL WINDING OF ELONGATED OBJECTS, ESPECIALLY STRANDS OF HAIR

The invention relates to an apparatus for the winding at least one winding material in the form of a thread, strip, ribbon or the like around long objects, such as threads, strips, string, or materials in tubular or strand form, especially strands of hair.

In Africa and some other lands there are traditional hairdos composed of curled strands of hair in many different variations. At least in Africa itself the preparation of these hairdos is a highly developed art which even today must be performed exclusively by manual means.

Figure 1:
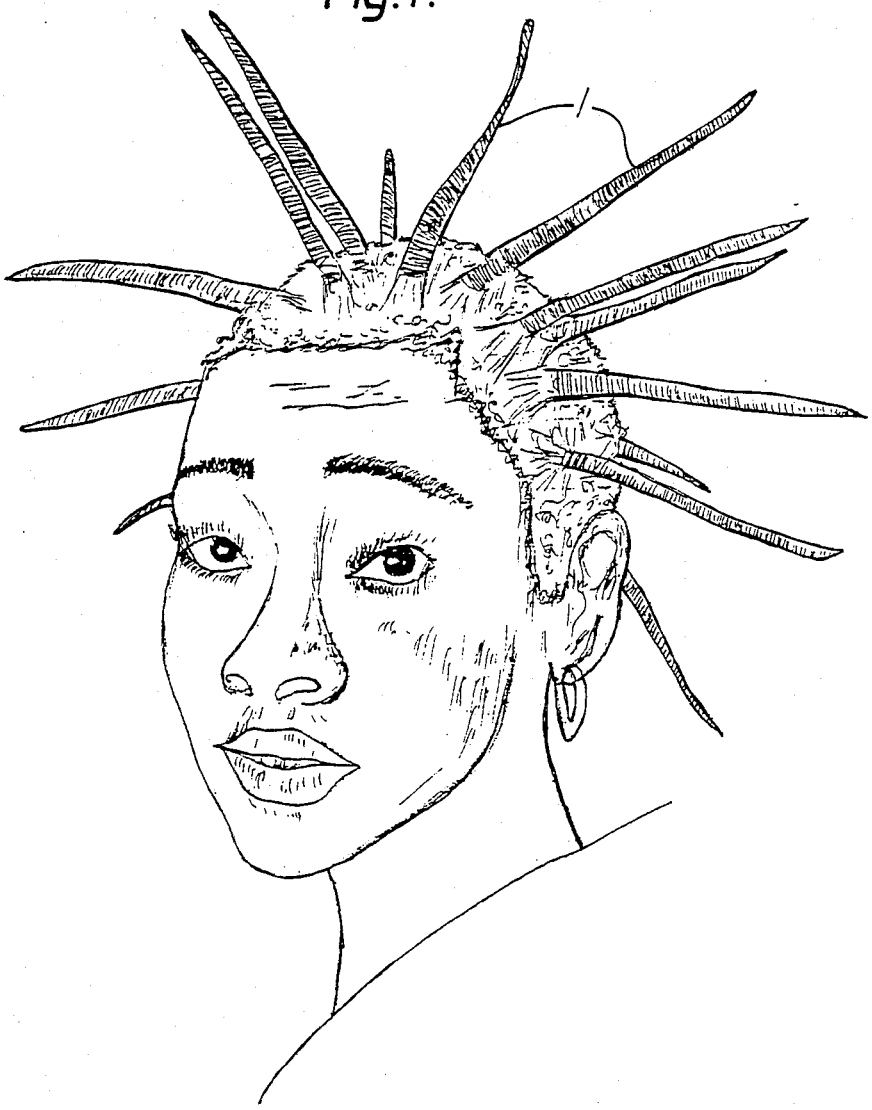
Figure 2:
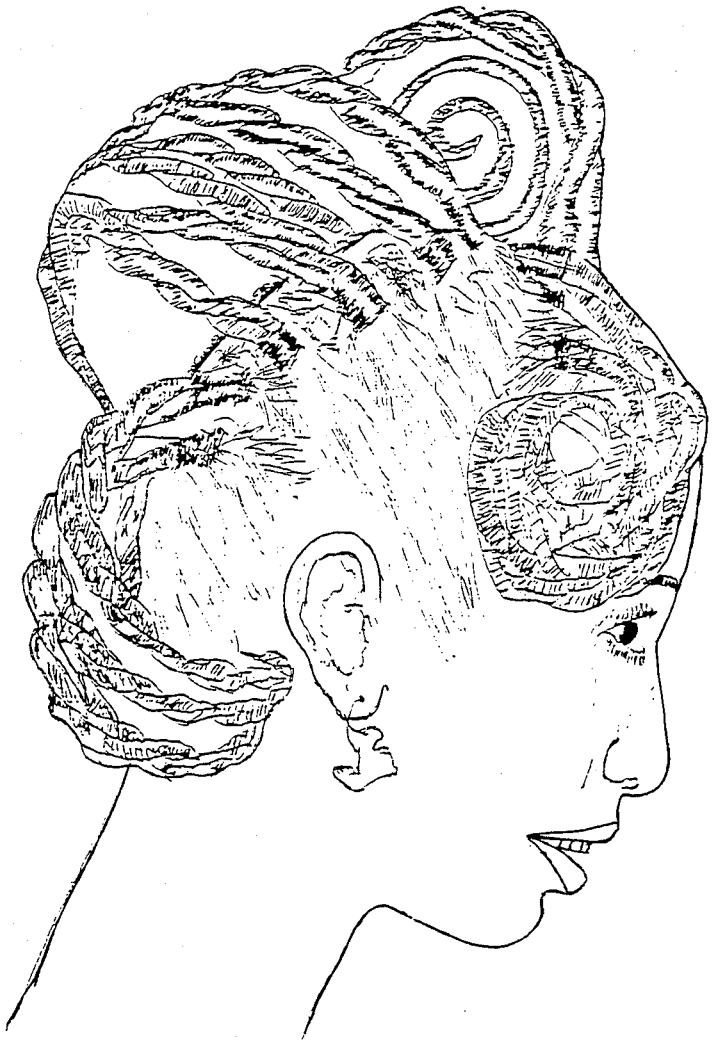

The basis of these hairdos is formed by a number of strands of hair which first are wound spirally with a thread and then bundled, laid together and bound together in the actual hairdo. In the appended drawing, FIG. 1 shows a number of hair strands already wrapped with a thread, while FIG. 2 shows a finished hairdo which consists of a great number of hair strands artfully assembled together and wrapped with threads.

The winding of a thread around strands of hair is nevertheless very time-consuming, whether friends and acquaintances or professional hairdressers perform it. Often three hours and more are needed for winding hair strands for a single hairdo. The production of such a hairdo is therefore not just time-consuming, but also entails considerable cost when a professional hairdresser is employed.

It is the object of the invention to create an apparatus of the kind described above which will be suitable especially for winding a thread around hair strands. This apparatus is not only to considerably speed up the actual winding, but also to enable it to be performed with a uniformity comparable with manual winding.

The apparatus is characterized by a casing; an annular disk rotatably mounted on the casing and having a central opening through which a tube for receiving the object extends; a motor for turning the disk; at least one spool for the winding material, said spool being journaled on the disk and rotatable about a shaft; and at least one guide for the winding material, fastened to the disk and disposed in the vicinity of one end of the tube.

The invention offers the advantage that the winding can be performed semiautomatically with an apparatus into which the hair strands to be wound with a thread are inserted, simply by turning on a motor and then gradually moving the entire apparatus from the base of the hair toward the ends of the hair. With the apparatus according to the invention the length of time it takes to perform the winding can be reduced greatly in comparison to the former winding time.

The invention will be further explained below in conjunction with the appended drawing and a preferred embodiment.

Figure 3:
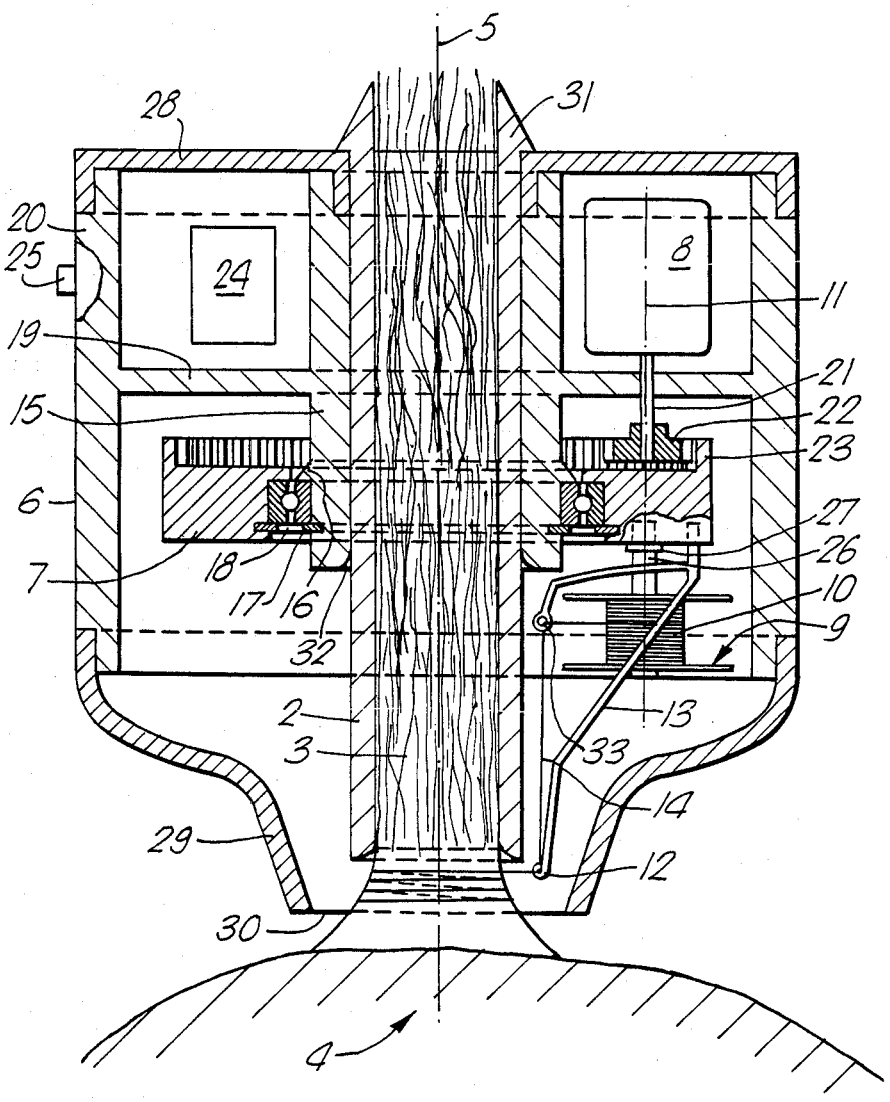
Figure 4:
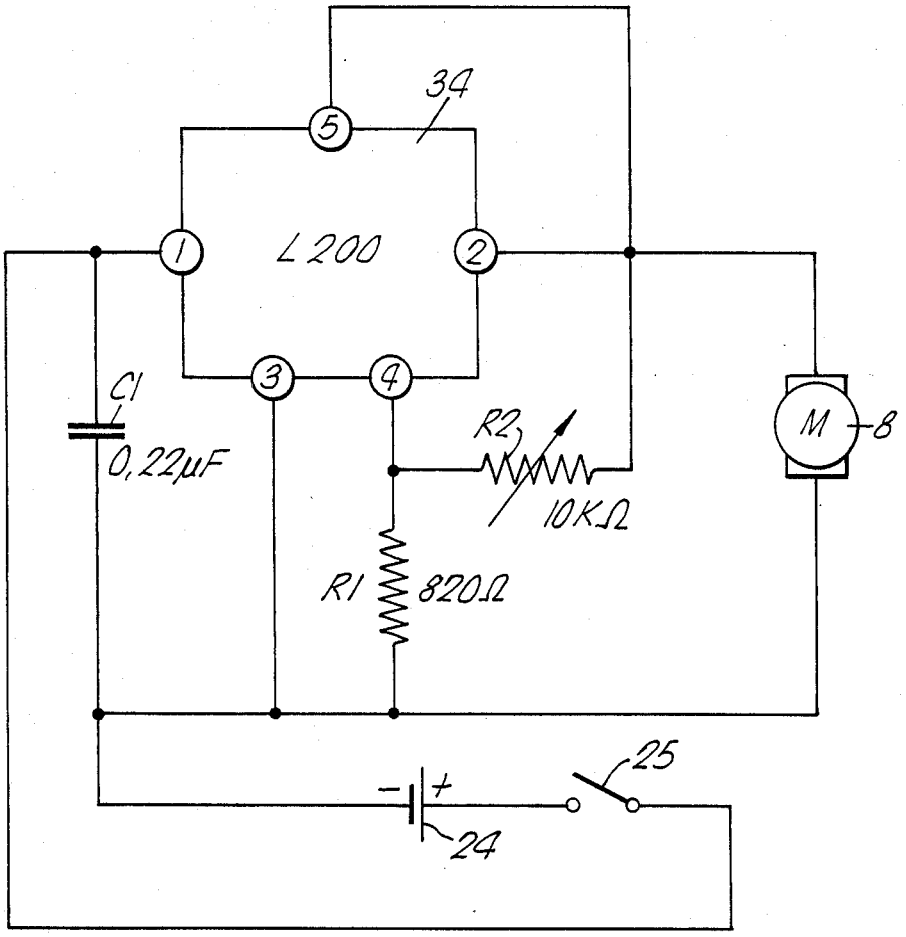

FIG. 1 shows a woman's head with a number of hair strands already wound with a thread, FIG. 2 shows a woman's head with a hairdo composed of a great number of wound hair strands, FIG. 3 a longitudinal section through an apparatus according to the invention for winding a thread around a strand of hair, and FIG. 4 a circuit diagram for controlling the speed of a motor of the apparatus according to FIG. 3.

An important part of the apparatus according to the invention is a tube 2 which serves to receive an elongated object, e.g., a hair strand 3 which is on a diagrammatically indicated scalp 4, but has not yet been wound. The tube 2 has preferably a cylindrical internal cross section. The outer cross section is best also cylindrical. Furthermore, the tube 3 is preferably divided parallel to its axis 5, so that it can be opened for the insertion of the hair strand 3. For this purpose, however, the tube 3 can also be made in two parts and can consist, for example, of two identical cylinder halves which are provided along their confronting surfaces with pins and holes receiving them or the like which can be inserted one in the other with a friction fit. Hinging the two halves of the tube together can also be accomplished by making the tube, for example, of a plastic with a slit running parallel to the axis 5 and by forming on the diametrically opposite side a wall cross section so thin that the result is two tube halves which can be opened and closed about this wall section.

The apparatus furthermore has a casing 6 for the rotatable mounting of an annular disk 7 which is associated with a motor 8 to set it in rotation. According to FIG. 3, on the one side of the disk 7 which faces the scalp when the apparatus is in use there is mounted a spool 9 with a coil 10 of thread or a coil of ribbon, strip, wire, or the like, which can rotate about a shaft 11. On the same side a guide 12 is also fastened to the disk 7, which consists, for example, of an eyelet at the free end of an arm 13 through which runs the thread 14, wire or the like, unwound from the spool 9.

In the preferred embodiment represented, the casing 6 has a sleeve-like mounting 15 with a central opening whose inside cross section matches the outside cross section of the tube 2 and which serves to hold the latter in a light friction fit. On its outer side the mounting 15 has a projection 16 and a snap ring 17 between which the one ring of a bearing 18 disposed in the central opening of the disk 7 is held against axial displacement, while the other bearing ring is fastened to the disk 7. The bearing 18 consists, for example, of a ball or needle bearing.

The mounting 15 has in the axial direction a length which corresponds, for example, only to about half the length of the tube 2 and bears the bearing 18 and the disk at its extremity nearer the guide 12. From a middle part of the mounting 15 an annular disk 19 joined to the latter extends radially outward and bears a, for example, cylindrical casing portion 20 which envelops all other parts of the apparatus. On the annular disk 19 or on the casing portion 20 the motor 8 is supported, which has a drive shaft 21 preferably parallel to the axis 5 and extending through the annular disk 19, on which a pinion 22 is fastened. This pinion meshes with teeth which are formed on a raised edge 23 of the disk 7. A battery 24, which can be composed of a stack of several small batteries of, e.g., 1.5 volts each, and is supported also on the annular disk 19, serves to supply power for the motor 8. The motor 8 is furthermore switched so as to be able to turn it on as required and thereby cause the disk 7 to revolve. The spool 9 is fastened on a shaft which passes through the disk 7 and is held against axial displacement on both sides of the latter by means of snap rings 27 or the like. Furthermore, the shaft 26 is journaled in the disk 7, with its axis of rotation disposed preferably parallel to the axis 5.

The casing of the apparatus according to the invention, which is formed by the mounting 15, the annular disk 19 and the casing portion 20 has at one end a cover 28 which is preferably fastened to casing portion 20 releasably by a snap or friction fastening not represented, and has a central opening with an inside cross section corresponding to the outside cross section of the tube 2. On the opposite end of this casing an annular guard 29 is fastened to the casing portion 20 and tapers toward its free end, and it has only a small opening 30 suitable for the admission of the hair strand 3; it encompasses the path of movement of the guide 12 and, like the cover 28, it is preferably releasably fastened to the casing portion 20.

The tube 2 has at its upper end in FIG. 3 at least one resilient snap catch 31 with an undercut projection which limits the axial displacement of the tube 2 in the mounting 15 by engaging the upper surface of the cover 28. The catches 31 are made resilient such that the tube 2 in FIG. 3 can be inserted from the bottom through the mounting 15, which for this purpose preferably has an insertion chamfer 32. After the catches 31 have reached the position seen in FIG. 3, they snap behind the edge of the cover 28. In this axial position of the tube 2, its opposite end is close to the opening 30 of the annular guard 29. The guide 12 is then disposed slightly outside of and below the lower end of the tube in FIG. 3, so that it can perform without interference a rotary movement about the hair strand 3 inserted into the tube 2, the axis of rotation being preferably the axis 5, while at the same time not contacting the hair strand 3. The manner of operation of the described apparatus is as follows:

To wind thread 14 around the hair strand 3, first the tube 2 is withdrawn from the casing 6 by squeezing the catches 31 together with the hand or simply drawing the tube 2 upwardly in FIG. 3 out of the mounting 15. Then the hair strand 3 is laid into the tube 2, which is especially easy if the tube 2 consists, as described above, of two releasably joined parts or at least can be opened on a hinge. Then the tube 2 is inserted with the catches 29 first into the end of the mounting 15 which has the insertion chamfer 32, until the catches 31 snap behind the cover 28. Lastly, since the outer end of the hair strand 3 is gripped with the hand, the entire apparatus is advanced toward the scalp 4 until the opening 30 in the annular guard 29 is directly adjacent the scalp. The apparatus is then ready for the winding process.

The winding process is initiated by turning on the motor 8 with a switch 25, which is preferably a momentary contact switch which is mounted on the exterior of the casing portion 20. Thus the disk 7 begins to revolve about its shaft which preferably coincides with the axis 5, causing the spool 9 of thread and the thread guide 12 to move around the hair strand 3 held in the tube 2. If at the same time the free end of the thread 14 is held with the hand at the level of the base of the hair, this will result in a continuous unwinding of the thread 14 from the spool 9 and a winding of the thread around the hair strand 3, as indicated diagrammatically at the bottom part of FIG. 3.

To enable the hair strand 3 to be wound with thread on its entire length, the entire apparatus is gradually drawn away from the scalp 4. The guide 12, while simultaneously in rotatory movement, thus moves axially along the hair strand 3 until the latter is completely wound with the thread 14 and its outer end is still within the tube 2. The thread 14 is then snipped off, thus terminating the spiral winding process. The knotting of the free end of the thread is then performed in the usual manner. On account of the catch 31 there is no danger during the winding process that the tube will be drawn axially out of the mounting 15 due to any insufficient strength of the friction fit.

The described apparatus can furthermore be used in like manner for winding the hair of a wig.

The winding speed, i.e., the rotatory speed of the disk 7, can be fixed or variable. In either case the pitch of the spiral winding can be selected by adapting the axial speed with which the tube 2 is drawn along the hair strand 3. If it is desired also to make the thread tension adjustable during the winding process, it is desirable to provide for this purpose a brake 33 disposed between the guide 12 and the spool 9 and fastened likewise to the disk 7. Another brake, not shown, can be provided for the spool 9 and can act, for example, on the shaft 26.

The motor 8 is preferably a direct-current motor powered by a voltage of 9 volts, which is wired according to FIG. 4 with a circuit for controlling its speed. Although there are many motors and speed controls, a circuit with a voltage regulator 34 according to FIG. 4 (component L200 made by SGS ATES, with headquarters in Waltham, Mass., U.S.A.) is preferred. Terminal No. 1 of the voltage regulator 34 is connected through switch 25 to the positive pole of the battery 24 whose negative pole is connected directly to terminal No. 3 of the voltage regulator 34 and the one terminal of motor 8, and through a resistance R1 of, e.g., 820 ohms, to the No. 4 terminal of the voltage regulator 34. The other terminal of the motor 8 is directly connected through a potentiometer R2 of, for example, ten thousand ohms, to terminal No. 4 of the voltage regulator 34. Terminals Nos. 2 and 5 of the voltage regulator 34 are short-circuited, while terminals Nos. 1 and 3 are connected together by a condenser C1 of, for example, 0.22 microfarads.

By varying the setting of potentiometer R2 the motor can be connected through terminal No. 2 of the voltage regulator to different voltages which result in a corresponding change in rotatory speed. The potentiometer R2 is preferably mounted on the exterior of the casing 6 close to the switch 25. Instead of the circuit shown, simple circuits with resistors and potentiometers can be used, or transistor circuits.

The invention is not limited to the described, preferred embodiment, which can be modified in many ways. The tube 2 can, like the disk 7, be made, for example, of metal, wood or the like, but preferably of plastic, and can be provided with a section extending beyond the catches 31 and its upper end (FIG. 3) for the treatment of very long hair. Instead of the internal teeth on the disk 7 as represented, the margin 23 of the disk 7 can be provided with external teeth. Instead of the pinion 22 acting directly on the disk 7, other drive means can be provided, such as V-belt, cogbelt or chain drives or the like. Suitable as the thread spool 9 are preferably thread spools such as those commonly used in sewing machines. Furthermore, the motor 8 can be provided with a cord and plug to enable it to be connected to the ordinary power mains. It would furthermore be possible to power the motor 8 with bicycle generators, with solar or with wind energy, which would be desirable especially in third-world countries, where the necessary batteries or power lines are not always available. Also, instead of an electric motor, a mechanical motor can be provided, which has, for example, a mechanism powered by a windable spring, similar to a clockwork.

Lastly, the invention is not limited to the winding of hair strands, but can be applied in a corresponding manner to other elongated objects, such as threads, strips, bands, strings or the like of textile materials, wire, plastic or the like, or tubes, rods or the like. It is also possible to leave the apparatus in the stopped state and to pull the object to be wound through the tube 2. Also, instead of textile threads 14, other materials such as ribbons, strips or the like, of plastic wire, etc., can be used for winding the objects. Finally, a plurality of spools 9 and guides 12 can be fastened on the disk 7 in order to wind the objects simultaneously and selectively with several threads or the like.

I claim:

1. An apparatus for spirally winding a winding material in the form of at least one thread, strip, ribbon or the like, around an elongated object, such as a thread, strip, strand, tube or rod, especially a strand of hair, said apparatus comprising: a casing; a tube mounted in said casing for receiving and protecting the object without exerting any stress thereon; said tube having a first axis and two ends; an annular disk mounted in said casing for rotation relative to said tube and having a central passage through which said tube passes; a motor mounted at said casing and coupled to said disk for rotating the disk about said tube; at least one spool for storing the winding material thereon and being mounted on said disk for rotation about a second axis; and at least one guide fastened to said disk and disposed slightly outside of, and in close vicinity of, one of said two tube ends, for guiding, and for winding, the winding material about the object in the vicinity of said one tube end, upon rotation of said disk by said motor.

2. An apparatus according to claim 1, wherein the casing has a sleeve-like mounting, said tube being releasably accommodated in said mounting.

3. An apparatus according to claim 1, comprising a brake for the winding material, said brake being fastened to said disk.

4. An apparatus according to claim 1, wherein said casing is part of a housing which surrounds said disk, said spool, and said guide; said housing having two ends, each having an opening for the passage of at least one of the following: the object and said tube.

5. An apparatus according to claim 4, wherein said housing has a longitudinal axis coinciding with the first axis.

6. An apparatus according to claim 4, wherein said housing has a cover with one of said openings therein.

7. An apparatus according to claim 6, wherein said spool and said guide are disposed on a side of the disk facing away from said cover.

8. An apparatus according to claim 4, comprising an annular guard surrounding said spool, said guide and a section of said tube; said annular guard being releasably fastened to said housing.

9. An apparatus according to claim 1, wherein said motor has a drive shaft disposed parallel to said first axis, and a drive wheel fastened to said drive shaft and coupled to said disk for rotating the same.

10. An apparatus according to claim 9, wherein said drive wheel is a pinion, and said disk has a raised margin bearing teeth which mesh with said pinion.

11. An apparatus according to claim 1, wherein said spool has an axis of rotation which is disposed parallel to said first axis.

12. An apparatus according to claim 1, wherein said tube is divided along at least one line running parallel to said first axis.

* * * * *